US006203245B1

(12) United States Patent
Harten

(10) Patent No.: US 6,203,245 B1
(45) Date of Patent: Mar. 20, 2001

(54) CULVERT END GUARD

(76) Inventor: Elgin T. Harten, 727 Third Line East, Sault Ste. Marie, Ontario (CA), P6A 6J8

( * ) Notice: Subject to any disclaimer, the term of this patent is extended or adjusted under 35 U.S.C. 154(b) by 0 days.

(21) Appl. No.: 09/342,915

(22) Filed: Jun. 30, 1999

(51) Int. Cl.[7] ..... E01F 5/00
(52) U.S. Cl. ..... 405/125; 405/124; 138/107
(58) Field of Search ..... 405/124, 125, 405/126; 404/2, 4; 138/107; 248/73, 74.4; 285/61

(56) References Cited

U.S. PATENT DOCUMENTS

| | | | | |
|---|---|---|---|---|
| 546,245 | | 9/1895 | Parker . | |
| 567,653 | | 9/1896 | Parker . | |
| 786,059 | | 3/1905 | Simpson . | |
| 915,266 | * | 3/1909 | Boyd | 405/125 |
| 1,098,766 | * | 6/1914 | Scully et al. | 405/125 |
| 2,958,200 | * | 11/1960 | Russell | 405/125 |
| 5,971,663 | * | 10/1999 | Brothers | 405/125 |

* cited by examiner

*Primary Examiner*—David Bagnell
*Assistant Examiner*—Alexandra K. Pechhold
(74) *Attorney, Agent, or Firm*—Trevor C. Klotz

(57) ABSTRACT

A culvert end guard for use in surrounding and protecting an exterior end portion of a culvert and which is assembled from first and second like half shell sections is disclosed. Each half shell is T-shaped in configuration and includes a central limb portion, two end limb portions, an exterior surface and an interior surface. The interior surface of each half shell is further characterized by an open-ended channel of predetermined size and shape that is centrally disposed in and which extends in a direction along the central limb portion, and contact areas located on either side of the channel. When the first and second half shell sections are brought together in opposed and closed shell relationship, they engage one another along their respective contact areas and form from their respective channels a passageway through which the end of the culvert can extend.

22 Claims, 1 Drawing Sheet

CULVERT END GUARD

FIELD OF INVENTION

This invention relates to a guard for protecting the exterior end portions of culverts which are commonly employed for subterranean stream or water drainage purposes and which are frequently found under roads, driveways or the like where water drainage is of concern.

BACKGROUND OF INVENTION

Tubular steel culverts are well-known in the art and are commonly employed as an underground conduit for water. A long-recognized shortcoming of conduits of this nature and others constructed from different types of material, is that the extremities of the culverts are susceptible to breakage or deformation as a result of increased loading in this area. This normally is attributable to the weight of traversing vehicles travelling over culverts which have not been buried deeply.

A further shortcoming of tubular culverts, no matter what their cross-sectional shape may be, is the collection of unwanted debris at the culvert ends which impedes the flow of water and which commonly results from material in the slope or embankment, through which the culvert extends, collecting at the lower portion of the water inlet or discharge ends of the culvert. In situations where embankment subsistence is regarded as a problem that must be addressed, a common practice is to reinforce the embankment area surrounding the free ends of the conduit by a retaining wall formed from stonework, wire mesh or the like.

Parker, in U.S. Pat. No. 546,245, issued Sep. 10, 1889, discloses a sectionalized tubular culvert or pipe conduit with provision, at the exterior ends of the culvert or pipe, for providing for a retaining wall constructed from sectionalized end wall sections, including sections which interlock with the grooves provided in the exterior ends of the conduit. A variation on this is also disclosed by Parker in U.S. Pat. No. 567,653, issued Sep. 15, 1898. In yet another variation, Simpson, in U.S. Pat. No. 786,059, issued Mar. 28, 1905, discloses an arched subway structure constructed from semi-circular shell sections and which, at its free ends, is provided with an outwardly-projecting semi-circular flange, and against the interior face of which, reinforcing wall sections abut.

While the foregoing prior art references are also representative of other types of retaining walls used with conduits, tunnels or the like, they are not concerned with protecting the end portion of a conduit which, as a result of its installation or location, is exposed to periodic loading which can break, or in the case of metal culverts, deform at the ends of the culvert, and which can also result in the collection of unwanted debris in the inlet and discharge areas of the culvert.

SUMMARY OF INVENTION

The novel culvert guard of my invention is designed to surround and protect the exterior end portion of a culvert from excess loading and simultaneously create a retaining wall section about the culvert end, and particularly on either side of the culvert end, to thereby assist in reducing the collection of embankment debris in the inlet and outlet areas of the culvert. Additionally, because each culvert end guard of my invention is assembled from two substantially identical or like half sections, when guards are used at either end of a conduit, at the time the conduit is laid down in a trench, it can conveniently and advantageously be positioned in location on the bottom half sections of the guards prior to the placement of the upper mating half sections, and then backfilling the trench.

In accordance with my invention, the end guard which is used to surround and protect an exterior end portion of a culvert is assembled from first and second like half shell sections. Each half shell is T-shaped, including a control limb portion and two end limb portions, imparting to it its T-shape configuration and also having an exterior surface and an interior surface. The interior surface is characterized by an open-ended channel of predetermined size and shape that is centrally disposed in and which extends in a direction along the central limb portion. The balance of the interior surface is made up of contact areas located on either side of the channel, such that when the first and second half shell sections are brought together in opposed and closed shell relationship, they engage one another along their respective contact areas and form from their respective channels, a passageway for the culvert.

The size and shape of the open-ended channel is dictated by the cross-sectional shape and dimensioning of the culvert two half shells are intended to surround and which, for example, can be oval or square but, most commonly, are circular in cross-section. Thus, when used with a conduit having a circular cross-section, the open-ended channel of each half shell is in the form of a half pipe which has a radius that is no less than the exterior radius of the tubular culvert, so as to receivingly accommodate at least half of the conduit when positioned therein.

The half shell sections, while being identical or substantially identical one to the other, are preferably separately formed from any suitable material, such as precast concrete. In this regard, the exterior surface of each half shell can include a T-shaped face and a surrounding side wall. The contact areas forming part of the interior surface and which are located on either side of the open-ended channel, may be offset relative one to the other, but preferably lie in the same plane and in a plane parallel to the plane of the T-shaped face.

The first and second half shell sections can be identical or substantially identical. In this latter regard, the first half shell section when used as the top half shell section, may slightly differ from the second, lower, half shell section, by having that portion of its is sidewall which extends from one free end to the other free end of its two end limb portions (and which forms one half of the outermost sidewall of the culvert guard when installed), extend downwardly and outwardly from its T-shaped face rather than perpendicular to the T-shaped face. In other words, the outermost sidewall of the top half shell section can project outwardly over the outermost sidewall of the underlying or lower half shell section and by doing so, provides a zone adjacent the outermost sidewall of the lower half shell section which is lees susceptible to water blockage by embankment subsistence.

When the two half shells are brought together in opposed and closed shell relationship to thereby surround and protect the exterior end portion of the culvert, means can also be provided for maintaining the two half shells in this relationship. Suitable means includes the provision of a plurality of rod receiving holes which each extend fully through the exterior surface and the contact areas of the interior surface. Once interconnecting rods are inserted through the holes of mating half shells, lateral movement of one shell section relative to the other is not possible.

Another form of maintaining the two half shells in opposed and closed shell relationship is to provide for, on each half shell, at least one rib which projects outwardly from the contact area on one side of the open-ended channel, and an equal number of rib receiving depressions which are correspondingly located in the contact area on the other side of the channel. When the rib of one half section is inserted into the rib receiving depression of the other half section, the two sections become interlocked and resistant to relative lateral displacement.

As will be appreciated, the two end limb portions of each T-shaped half shell which extend laterally on either side of the end of the culvert, function as a reinforcing wall for the embankment about the culvert and also create an enlarged water collection area or basin at the ends of the culvert.

DETAILED DESCRIPTION OF DRAWINGS

Figure 1:
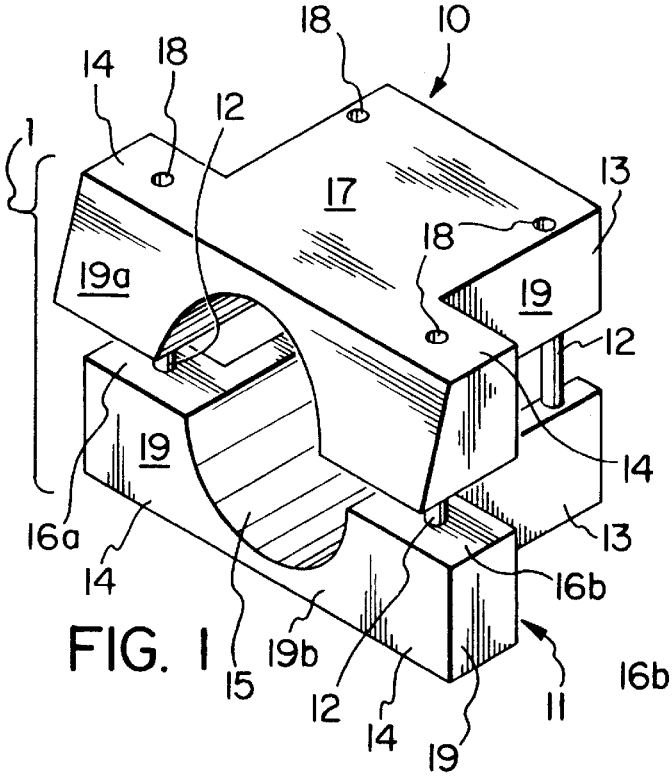
FIG. 1 is a perspective exploded view of two matingly opposed half shell sections employing rods to maintain them in alignment.

Referring initially to FIG. 1, and as illustrated, the culvert end guard is assembled from two substantially identical half shell sections 10 and 11, positioned in opposed and mating relationship to form a guard 1 for the end portion of a culvert. Each half shell is T-shaped, having a central limb portion 13 and two end limb portions 14. As illustrated in FIG. 1, the exterior surface of the T-shaped half shell is provided with a planar T-shaped face 17 and surrounding side wall 19.

The interior surface of each half shell 10 is provided with an open-ended channel 15 which, on either side of the channel, includes contact areas 16*a* and 16*b* which matingly engage the corresponding surface areas on the other half shell section. Holes 18 extending through the half shells permit the passage and placement of rods 12 therethrough in order to maintain the two half shell sections together in closed shell relationship.

The only difference between the top half shell 10 and bottom half shell 11 illustrated in FIG. 1 relates to that portion of surrounding sidewall 19 which extends between the free ends of the two end limb portions 14,and which are respectively identified as sidewall portions 19*a* and 19*b*, and which, together, make up the outermost sidewall of guard 1. Relative to the T-shaped face 17, sidewall portion 19*a* of half shell 10 extends downwardly and outwardly so as to project outwardly over sidewall portion 19*b* of lower half shell section 11. Sidewall portion 19*b* extends in a plane perpendicular to its own T-shaped face (not shown) and T-shaped face 17 of half shell 10. The inclined surface 19*a* of sidewall portion 19 of upper half shell 10 assists in deflecting falling material such as sand or gravel which overlies it or which is adjacent its ends from collecting adjacent underlying sidewall portion 19*b* of half shell 11.

It will be appreciated that the two half shell sections 10 and 11 of FIG. 1 can be identical, and in which case, inclined sidewall portion 19*a* of top half shell 10 is dispensed with and replaced with a sidewall portion identical to sidewall portion 19*b* seen on half shell section 11.

Figure 2:
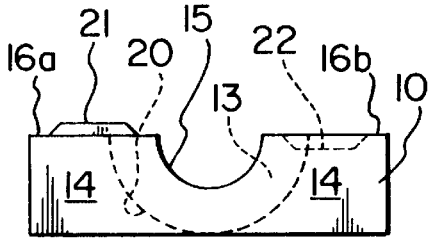
FIGS. 2, 3 and 4 are, respectively, front, interior plan and rear views of a half shell section a-employing ribs and rib depressions for matingly aligning like half shell sections together.
Figure 3:
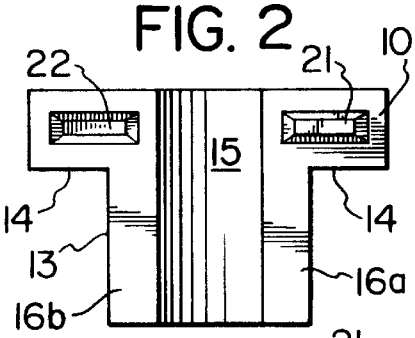
Figure 4:
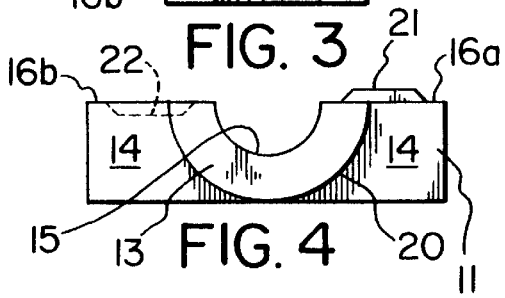

The half shell illustrated in FIGS. 2, 3 and 4 is similar to that of the half shell 11 seen in FIG. 1. However, the side areas 16*a* and 16*b* forming part of the half shell interior are respectively provided with a raised rib 21 and a rib receiving depression 22, which function in a manner similar to the aforementioned rods 12 in order to maintain two half shell sections in alignment when positioned in closed shell relationship. As also seen in these drawings, the exterior surface 20 of a major portion of the central limb 13 is in the shape of a half pipe complimenting the half-pipe configuration of open-ended channel 15.

While the open-ended channel 15, in cross-section, has been illustrated in the drawings as being semi-circular, it will be recognized that this channel can be of a different cross-sectional shape and size, depending upon the cross-sectional shape and dimensioning of the culvert it is intended to surround.

Figure 5:
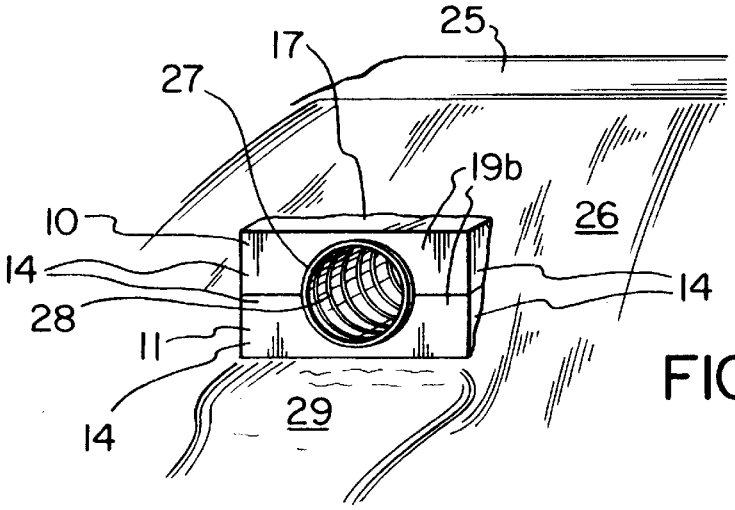
FIG. 5 is a perspective view of a road embankment illustrating the culvert end guard in situ.

FIG. 5 graphically illustrates the culvert end guard of my invention (without the inclined sidewall portion 19*a* referred to above in connection with FIG. 1) when extending under roadway 25 and projecting out from road embankment 26. Opposed half shell sections 10 and 11 are identical and each have the same sidewall portion 19*a*. Their respective open-ended channels 15 together form a circular passageway surrounding the free end 27 of culvert 28 extending therethrough. End limbs 14 projecting laterally on either side of culvert 28, in addition to providing a retaining wall for road embankment 26, creates an enlarged basin or catchment area 29 for water collection.

I claim:

1. A culvert guard half shell formed from precast concrete for use with another like half shell and which when said half shells are mated together one on top of the other in opposed and closed shell relationship, form a passageway therebetween for surrounding and protecting an exterior end portion of a tubular culvert; said half shell being T-shaped and having a central limb portion, two end limb portions, an exterior surface and an interior surface, said interior surface being provided with an open-ended elongate channel in the form of a half pipe which has a radius that is no less than the exterior radius of said tubular culvert and which is centrally disposed in and which extends in a direction along said central limb portion, and contact areas located on either side of said channel for engaging the contact areas on said like half shell when said half shells are brought together in opposed and closed shell relationship.

2. The culvert guard half shell as claimed in claim 1, wherein said exterior surface includes a planar T-shaped face and a surrounding sidewall.

3. The culvert guard half shell as claimed in claim 2, wherein said contact areas located on either side of said channel are planar and lie in the same plane.

4. The culvert guard half shell as claimed in claim 3, wherein said surrounding sidewall is perpendicular to said T-shaped face and said contact areas.

5. The culvert guard half shell as claimed in claim 4, including means for maintaining said half shell in opposed and closed shell relationship with said like half shell.

6. The culvert guard half shell as claimed in claim 5, wherein said means for maintaining said half shell in opposed and closed shell relationship with said like half shell includes a plurality of rod receiving holes which each extend fully through said exterior surface and said contact areas.

7. The culvert guard half shell as claimed in claim 5, wherein said means for maintaining said half shell in opposed and closed shell relationship with said like half shell includes at least one rib which projects outwardly from the contact area on one side of said channel and equal number of rib receiving depressions correspondingly located in the contact area on the other side of said channel.

8. The culvert guard half shell as claimed in claim 3, wherein a portion of said sidewall of said top half shell which extends from one free end to the other free end of said two end limb portions also extends downwardly and outwardly from said planar T-shaped face.

9. The culvert guard half shell as claimed in claim 8, including means for maintaining said half shell in opposed and closed shell relationship with said like half shell.

10. The culvert guard half shell as claimed in claim 9, wherein said means for maintaining said half shell in opposed and closed shell relationship with said like half shell includes a plurality of rod receiving holes which each extend fully through said exterior surface and said contact areas.

11. The culvert guard half shell as claimed in claim 9, wherein said means for maintaining said half shell in opposed and closed shell relationship with said like half shell includes at least one rib which projects outwardly from the contact area on one side of said channel and equal number of rib receiving depressions correspondingly located in the contact area on the other side of said channel.

12. A culvert end guard for use in surrounding and protecting an exterior end portion of a tubular culvert and which is assembled from first and second like half shell sections formed from precast concrete, wherein each said half shell is T-shaped and has a central limb portion, two end limb portions, an exterior surface and an interior surface, said interior surface being further characterized by an open-ended elongate channel in the form of a half pipe which has a radius that is no less than the exterior radius of said tubular culvert, that is centrally disposed in and which extends in a direction along said central limb portion and contact areas located on either side of said channel, whereby when said first and second half shell sections are brought together one on top of the other in opposed and closed shell relationship, they engage one another along their respective contact areas and form from their respective channels an elongate passageway for said culvert.

13. The culvert end guard as claimed in claim 12, wherein the exterior surface of each said half shell section includes a planar T-shaped face and a surrounding side wall.

14. The culvert end guard as claimed in claim 13, wherein the contact areas on either side of said channel are planar and lie in the same plane.

15. The culvert end guard as claimed in claim 14, wherein said surrounding sidewall is perpendicular to said planar T-shaped face and said contact areas.

16. The culvert end guard as claimed in claim 15, including means for maintaining said first half shell in opposed and closed shell relationship with said second half shell.

17. The culvert end guard as claimed in claim 15, wherein said means for maintaining said first half shell in opposed and closed shell relationship with said like second shell includes a plurality of rod receiving holes which each extend fully through said exterior surface and said contact areas of said interior surface.

18. The culvert end guard as claimed in claim 15, wherein said means for maintaining said first half shell in opposed and closed shell relationship with said second half shell includes on each said half shell at least one rib which projects outwardly from the contact area on one side of said channel and equal number of rib receiving depressions correspondingly located in the contact area on the other side of said channel.

19. The culvert end guard as claimed in claim 14, wherein said first shell section is located on top of said second half shell section and wherein a portion of said sidewall of said first half shell section which extends from one free end to the other free end of said two end limb portions also extends downwardly and outwardly from said planar T-shaped face.

20. The culvert end guard as claimed in claim 19, including means for maintaining said first half shell in opposed and closed shell relationship with said second half shell.

21. The culvert end guard as claimed in claim 19, wherein said means for maintaining said first half shell in opposed and closed shell relationship with said like second shell includes a plurality of rod receiving holes which each extend fully through said exterior surface and said contact areas of said interior surface.

22. The culvert end guard as claimed in claim 19, wherein said means for maintaining said first half shell in opposed and closed shell relationship with said second half shell includes on each said half shell at least one rib which projects outwardly from the contact area on one side of said channel and equal number of rib receiving depressions correspondingly located in the contact area on the other side of said channel.

* * * * *